US011344082B1

(12) United States Patent
Evans

(10) Patent No.: US 11,344,082 B1
(45) Date of Patent: May 31, 2022

(54) SHOE SOLE COVER

(71) Applicant: SoleScreens LLC, Mansfield, OH (US)

(72) Inventor: Di'Json Clifford Evans, Mansfield, OH (US)

(73) Assignee: SoleScreens LLC, Mansfield, OH (US)

( * ) Notice: Subject to any disclaimer, the term of this patent is extended or adjusted under 35 U.S.C. 154(b) by 0 days.

(21) Appl. No.: 17/352,453

(22) Filed: Jun. 21, 2021

(51) Int. Cl.

| | |
|---|---|
| ***A43B 3/16*** | (2022.01) |
| ***A43B 13/36*** | (2006.01) |
| ***A43C 13/00*** | (2006.01) |
| ***A43B 13/02*** | (2022.01) |

(52) U.S. Cl.
CPC ..... *A43B 13/36* (2013.01); *A43B 3/16* (2013.01); *A43B 13/02* (2013.01); *A43C 13/00* (2013.01)

(58) Field of Classification Search
CPC ..... A43B 13/36; A43B 3/16; A43C 13/12; A43C 13/00
USPC ..... 36/7.1 R, 7.5, 73, 135
See application file for complete search history.

(56) References Cited

U.S. PATENT DOCUMENTS

| | | | | | |
|---|---|---|---|---|---|
| 2,032,052 | A * | 2/1936 | Friedenberg | A43B 5/18 | 36/7.3 |
| 2,068,238 | A * | 1/1937 | Malm | A43B 3/16 | 36/7.3 |
| 2,254,685 | A * | 9/1941 | Jackson | A43B 3/16 | 36/7.3 |
| 2,257,902 | A * | 10/1941 | De Noronha | A43B 3/16 | 36/7.3 |
| 2,787,063 | A * | 4/1957 | Austin | A43B 3/16 | 36/58.6 |
| 2,958,963 | A * | 11/1960 | Lougheed | A43B 5/18 | 36/7.5 |
| 3,009,269 | A * | 11/1961 | Folk | A43B 3/16 | 36/7.5 |
| 3,354,562 | A | 11/1967 | Munari | | |
| 3,903,620 | A | 9/1975 | Gillet | | |

(Continued)

FOREIGN PATENT DOCUMENTS

| | | | |
|---|---|---|---|
| CN | 2831817 | Y | 11/2006 |
| CN | 205306131 | U | 6/2016 |

(Continued)

*Primary Examiner* — Marie D Bays
(74) *Attorney, Agent, or Firm* — Brett A. Schenck

(57) ABSTRACT

An apparatus is provided that includes a sole cover. The sole cover is configured to be removably attached to a sole of a shoe to cover the sole of the shoe. The sole cover includes a first covering section and a second covering section, where the first covering section is configured to cover the sole of the shoe at a toe box portion of the shoe. The second covering section is configured to cover the sole of the shoe at a waist portion of the shoe. The first covering section angles upwardly and away from the second covering section at an angle relative to the second covering section at an angle relative to the second covering section when the second covering section lies flat on a horizontal plane in an undeformed state. The sole cover is of a sufficient elasticity that enables the first covering section to bend downwardly when the sole cover is attached to the sole of the shoe. The angle and elasticity are of sufficient values to urge the sole cover against a bottom of the sole of the shoe to help secure the sole cover to the sole of the shoe when the sole cover is attached to the sole of the shoe.

20 Claims, 10 Drawing Sheets

(56) References Cited

U.S. PATENT DOCUMENTS

| | | | | |
|---|---|---|---|---|
| 4,377,042 | A * | 3/1983 | Bauer | A43B 13/36 36/101 |
| 5,083,385 | A * | 1/1992 | Halford | A43B 13/36 36/100 |
| 5,398,429 | A | 3/1995 | Olsen | |
| 5,615,495 | A * | 4/1997 | Mastrocola | A43B 3/163 36/2.6 |
| 5,661,915 | A * | 9/1997 | Smith | A43B 3/24 36/101 |
| 6,946,196 | B2 * | 9/2005 | Foss | A61F 13/8405 428/373 |
| 6,948,261 | B1 * | 9/2005 | Grasso | A43B 5/18 36/100 |
| 8,024,872 | B2 | 9/2011 | Pettis | |
| 10,398,195 | B1 | 9/2019 | Donaghue | |
| 2004/0221486 | A1 | 11/2004 | Dennison | |
| 2006/0207123 | A1 | 9/2006 | Milner et al. | |
| 2008/0163518 | A1 | 7/2008 | Pettis | |
| 2009/0049711 | A1 * | 2/2009 | Finch | A43B 1/0036 36/7.6 |
| 2010/0043255 | A1 | 2/2010 | Trevino | |
| 2010/0221474 | A1 * | 9/2010 | Prissok | C08K 5/41 524/106 |
| 2011/0047829 | A1 * | 3/2011 | Bell | A43C 15/161 36/62 |
| 2012/0066938 | A1 | 3/2012 | French et al. | |
| 2012/0124865 | A1 * | 5/2012 | Opie | A43B 3/18 36/73 |
| 2012/0216428 | A1 | 8/2012 | Marandos | |
| 2012/0285041 | A1 * | 11/2012 | Klein | A43B 3/246 36/83 |
| 2013/0074363 | A1 * | 3/2013 | Adams | A43B 3/18 36/7.1 R |
| 2013/0255102 | A1 | 10/2013 | Terrell | |
| 2014/0048214 | A1 | 2/2014 | Dhillon | |
| 2014/0075787 | A1 | 3/2014 | Cartagena | |
| 2014/0075791 | A1 * | 3/2014 | Smith | A43B 3/246 36/72 R |
| 2014/0230275 | A1 | 8/2014 | Matheny | |
| 2014/0298683 | A1 * | 10/2014 | Lee | A43B 3/16 36/73 |
| 2014/0325875 | A1 * | 11/2014 | Lee | A43B 3/0078 36/73 |
| 2015/0135449 | A1 | 5/2015 | Jackson | |
| 2015/0189948 | A1 | 7/2015 | Abrams | |
| 2016/0007678 | A1 | 1/2016 | Silverman | |
| 2016/0029739 | A1 * | 2/2016 | Dias | A43B 3/246 36/103 |
| 2016/0088897 | A1 * | 3/2016 | Lee | A43B 13/36 36/25 R |
| 2016/0235166 | A1 | 8/2016 | Bryan | |
| 2017/0318909 | A1 | 11/2017 | Gilbert | |
| 2018/0116330 | A1 | 5/2018 | Christian | |
| 2018/0271206 | A1 | 9/2018 | Corbett | |
| 2019/0142110 | A1 * | 5/2019 | Cruz | A43B 13/36 36/15 |

FOREIGN PATENT DOCUMENTS

| | | | |
|---|---|---|---|
| DE | 4413187 | A1 | 10/1995 |
| DE | 4421754 | A1 | 1/1996 |
| DE | 29605177 | U1 | 6/1996 |
| DE | 20205874 | U1 | 8/2003 |
| DE | 102009025825 | A1 | 11/2010 |
| DE | 202010015208 | U1 | 3/2011 |
| DE | 102014118638 | B3 | 12/2015 |
| EP | 2253235 | A1 | 11/2010 |
| ES | 1050388 | U | 4/2002 |
| FR | 2519240 | A | 7/1983 |
| GB | 2478975 | A | 9/2011 |
| GR | 20070100094 | A | 9/2008 |
| KR | 20140080963 | A | 7/2014 |
| KR | 101799939 | B | 11/2017 |
| KR | 20180125200 | A | 11/2018 |
| KR | 20200066892 | A | 6/2020 |
| RU | 104828 | U | 5/2011 |

* cited by examiner

SHOE SOLE COVER

FIELD

This application relates generally to footwear and accessories, and in particular a sole cover for a shoe.

BACKGROUND

Shoes can be easily damaged due to ordinary wear and tear, especially at vulnerable areas on the shoes such as the bottom and sides. Covers can be attached to the shoe to protect it. Often such covers may not be aesthetically pleasing or durable and may cover artistic shoes designs on the exterior surface. One example of a cover has peel and stick layers that can be attached to and removed from the bottom of the sole of the shoes. However, the peel and stick cover requires adhesive to attach the cover to the shoe and cannot be reliably removed and reattached.

Shoe covers may benefit from improvements.

SUMMARY

In one aspect of the present invention, an apparatus is provided that includes a sole cover. The sole cover is configured to be removably attached to the sole of a shoe to cover the sole of the shoe. The sole cover includes a first covering section and a second covering section, where the first covering section is configured to cover the sole of the shoe at the toe box portion of the shoe. The second covering section is configured to cover the sole of the shoe at the waist portion of the shoe. The first covering section angles upwardly and away from the second covering section at an angle relative to the second covering section when the second covering section lies flat on a horizontal plane in an undeformed state. The sole cover is of a sufficient elasticity that enables the first covering section to bend downwardly when the sole cover is attached to the sole of the shoe. The angle and elasticity are of sufficient values to urge the sole cover against the bottom of the sole of the shoe to help secure the sole cover to the sole of the shoe when the sole cover is attached to the sole of the shoe.

In another aspect of the present invention, an apparatus is provided. The apparatus includes a shoe. The shoe includes a sole, a toe box portion, a waist portion, and a heel portion. The apparatus further includes a sole cover. The sole cover is removably attached to the sole of the shoe to cover the sole of the shoe. The sole cover includes a first covering section and a second covering section. The first covering section covers the sole of the shoe at the toe box portion of the shoe. The second covering section is configured to cover the sole of the shoe at the waist portion and the heel portion of the shoe. The first covering section angles upwardly and away from the second covering section at an angle relative to the second covering section when the second covering section lies flat on a horizontal plane in an undeformed state. The sole cover is of a sufficient elasticity that enables the first covering section to bend downwardly when the sole cover is attached to the sole of the shoe. The angle and elasticity are of sufficient values to urge the sole cover against the bottom of the sole of the shoe to help secure the sole cover to the sole of the shoe when the sole cover is attached to the sole of the shoe.

Other aspects of the disclosed invention will become apparent from the following detailed description, the accompanying drawings and the appended claims.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

DETAILED DESCRIPTION

It will be readily understood that the components of the embodiments as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, etc. In other instances, well-known structures, materials, or operations are not shown or described in detail to avoid obfuscation. The following description is intended only by way of example, and simply illustrates certain example embodiments.

Figure 6:
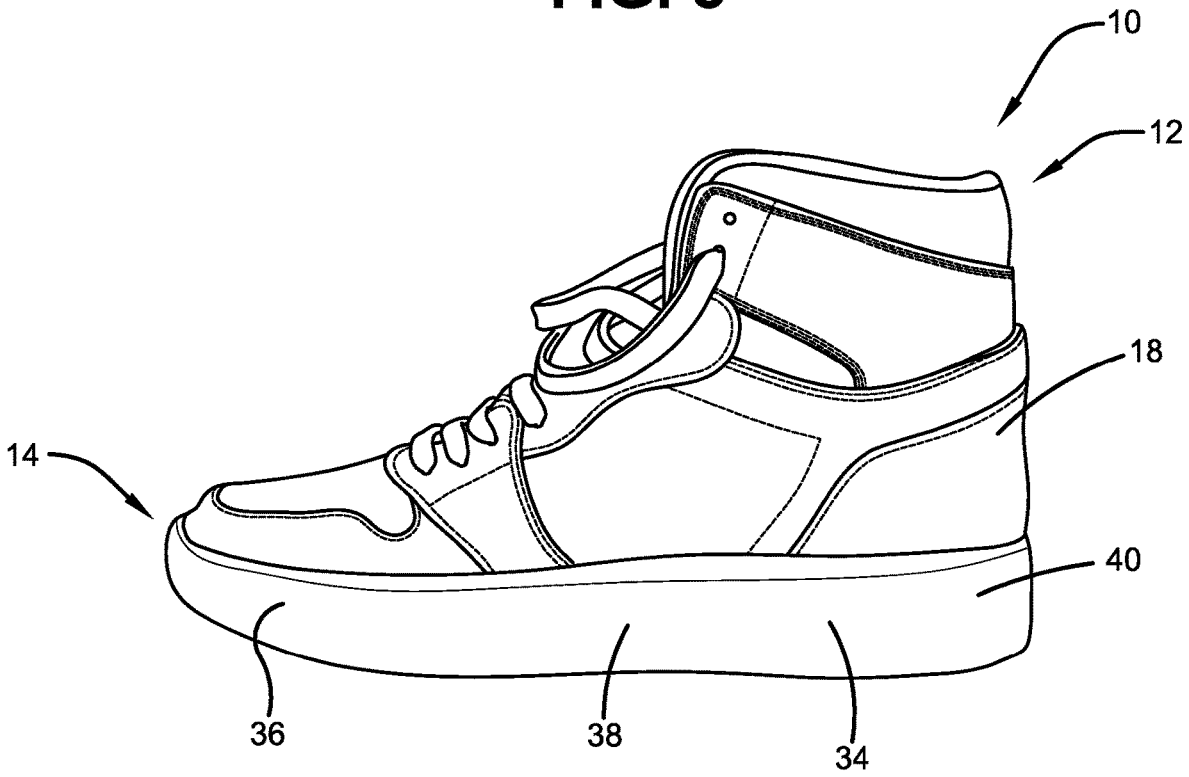
FIG. 6 is a right-side perspective view of the sole cover of FIG. 1 attached to the shoe of FIG. 5 according to the first embodiment of the present invention.

Throughout the present description, the terms "upper", "lower", "top", "bottom", "left", "right", "front", "forward", "rear", and "rearward" shall define directions or orientations with respect to the shoe and sole cover as illustrated in FIG. 6, which shows a right side perspective view of the shoe with the sole cover on it. It will be understood that the spatially relative terms "upper", "lower", "top", "bottom", "left", "right", "front", "forward", "rear", and "rearward" are intended to encompass different orientations of the shoe in use or operation in addition to the orientation depicted in the figures. For example, if the shoe in the figures is turned over, elements described as "upper" elements or features would then be "lower" elements or features.

Figure 5:
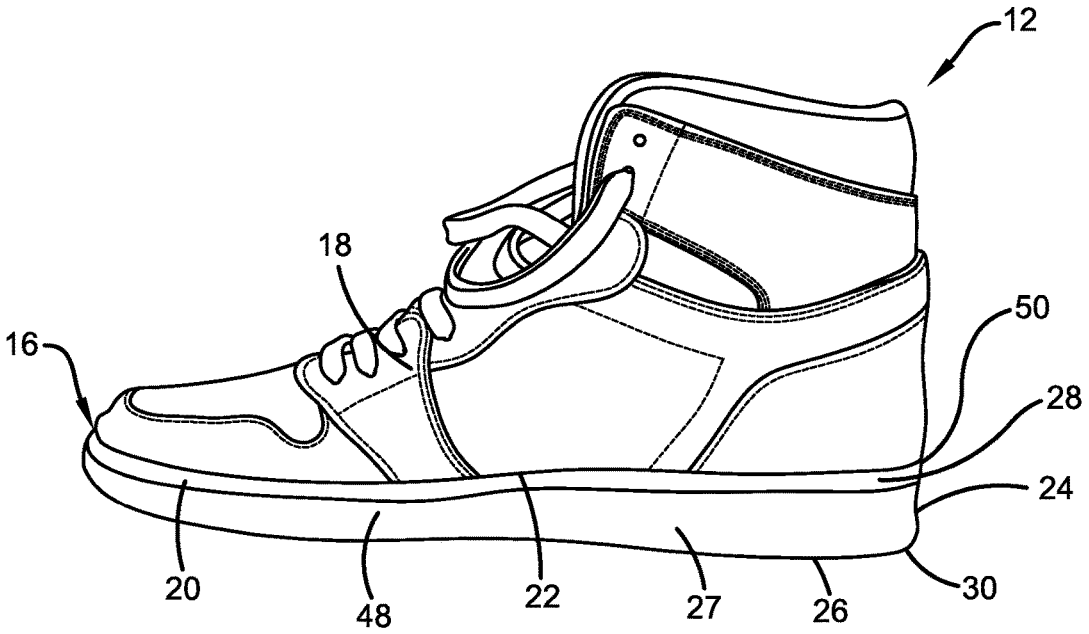
FIG. 5 is a right-side perspective view of a shoe that the sole covers of FIG. 1 and FIGS. 7-11 may be attached according to the embodiments of the present invention.

Referring to FIGS. 1-6, a first exemplary embodiment is provided. This first embodiment comprises an apparatus 10 (FIG. 6) that comprises a shoe 12 (FIGS. 5 and 6) which may be worn by a user and a sole cover 14 removably attached to the shoe 12. Referring to FIG. 5, the shoe 12 includes a sole 16, an upper 18, a toe box portion 20, a waist portion 22, and a heel portion 24. The sole 16 may be a one-layer type or may comprise multiple layers. The sole 16 may be made of suitable materials such as natural rubber, leather, polyurethane and/or PVC compound. The sole 16 may include an outsole 26, a midsole 27, and an insole 28. The outsole 26 is the outermost layer and generally covers the bottom of the shoe 12. The outsole has a bottom surface 30 that contacts the ground. The midsole 27 extends along the side periphery of the shoe and is positioned between the insole 28 and the outsole 26. The insole 28 is attached on the top of the midsole 27 and functions to cradle the foot.

The insole 28 is also attached to the bottom of the upper 18 by a welt (not shown). The upper 18 covers the upper foot of the wearer and is made of a durable and high strength material. The upper 18 is aesthetically designed to make the shoe attractive. The shoe 12 can be divided into three portions along the longitudinal axis of the shoes. These three portions are the toe box portion 20, the waist portion 22, and the heel portion 24. The toe box portion 20 of the shoe 12 is located at the front of the shoe 12 and covers the toes of the wearer to protect them. The toe box portion 20 is constructed to add strength to the front of the shoe 12, since the front of shoe 12 receives considerable stress. The heel portion 24 of the shoe 12 is at the rear of the shoe 12 to support the rear part of the shoe 12. The waist portion 22 is located between the heel portion 24 and the toe box portion 20 and protects the arch and in step of the foot of the wearer. In essence, the toe box portion 20 corresponds to the front shoe portion, the waist portion 22 corresponds to the middle shoe portion, and the heel portion 24 corresponds to the rear shoe portion.

Referring to FIGS. 1 to 4, the removable sole cover 14 is integrally formed in one piece by injection molding and includes a bottom wall 32 (FIG. 3) and an upstanding side wall 34 (FIG. 1) extending upwardly form the peripheral edge of the bottom wall 32. The side wall 34 extends continuously and unbroken around the periphery of the bottom wall 32 of the sole cover 14. The bottom wall 32 of the sole cover 14 has a bottom tread surface 44 (FIG. 3) that may have various designs. The sole cover 14 is made of an elastic material such as thermoplastic polyurethane (TPU). The sole cover 14 may include a silicon-based material and/or additives to increase its elasticity. The TPU may have a modulus of elasticity in the range between 0.25 GPa and 10 GPa. The sole cover 14 may also include additives that attenuate discoloration due to the elements. Additives may be a combination of Antioxidants, Hindered Light Amine Stabilizers (HALS), Ultraviolet (UV) Absorbers, and/or Quenchers. Another additive may be a phosphorescent and/or a pigment for aesthetic purposes.

Figure 1:
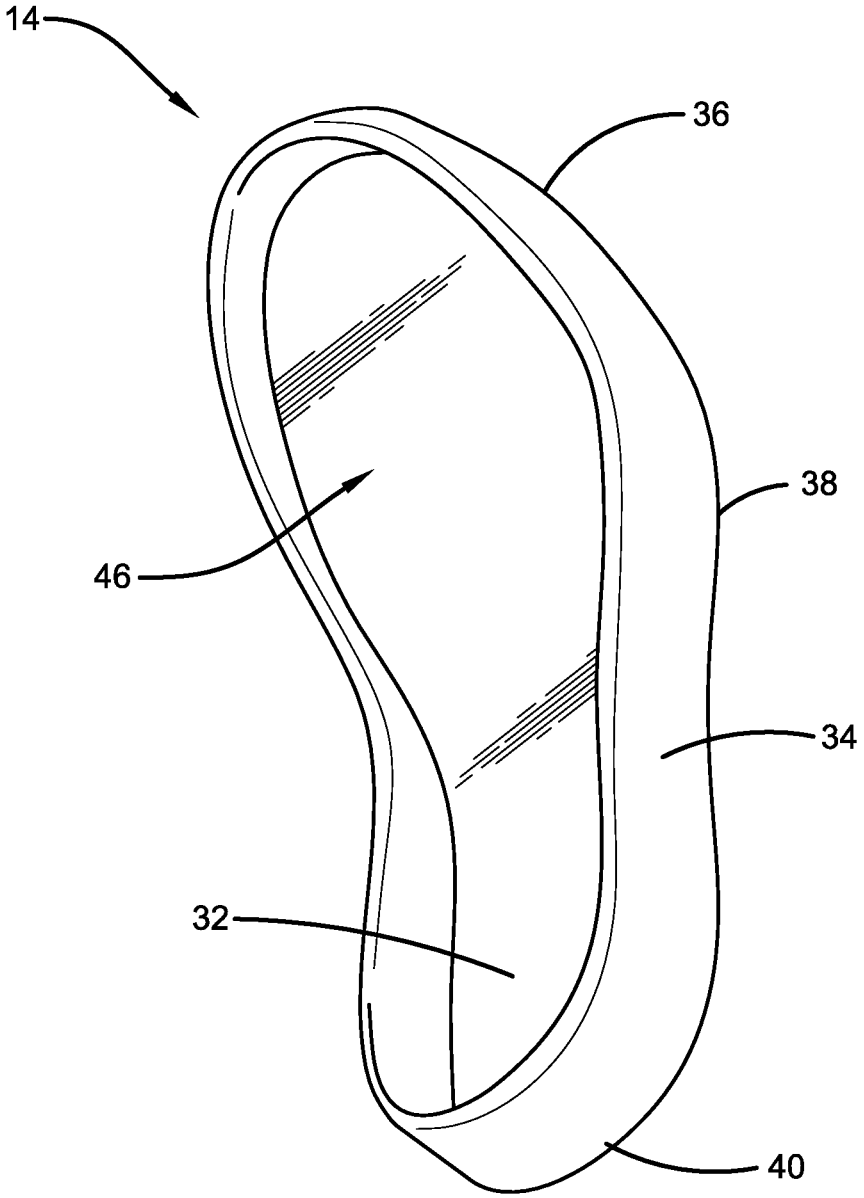
FIG. 1 is a top and rear perspective view of the sole cover according to a first embodiment of the present invention.
Figure 2:
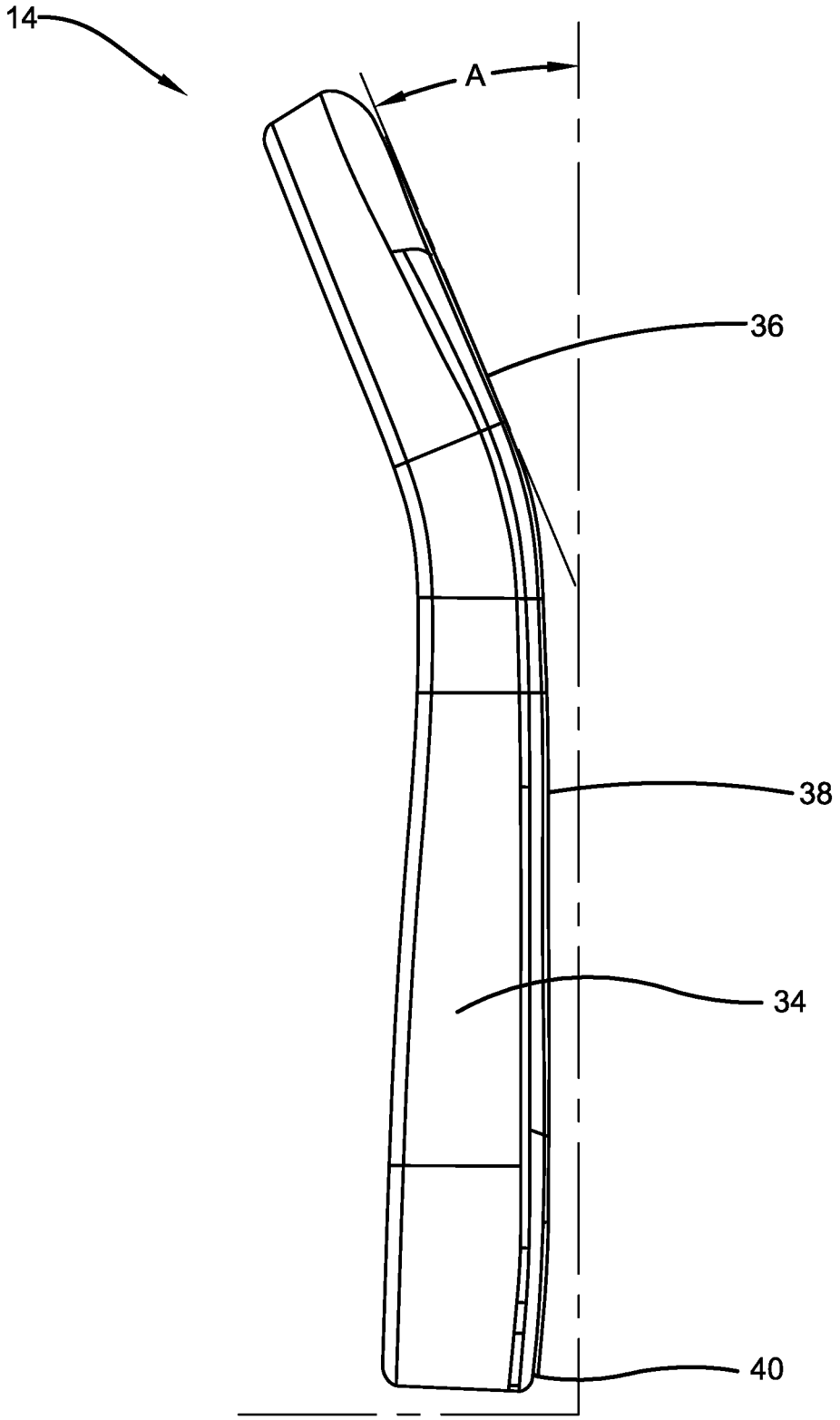
FIG. 2 is a left side view of the sole cover of FIG. 1.
Figure 3:
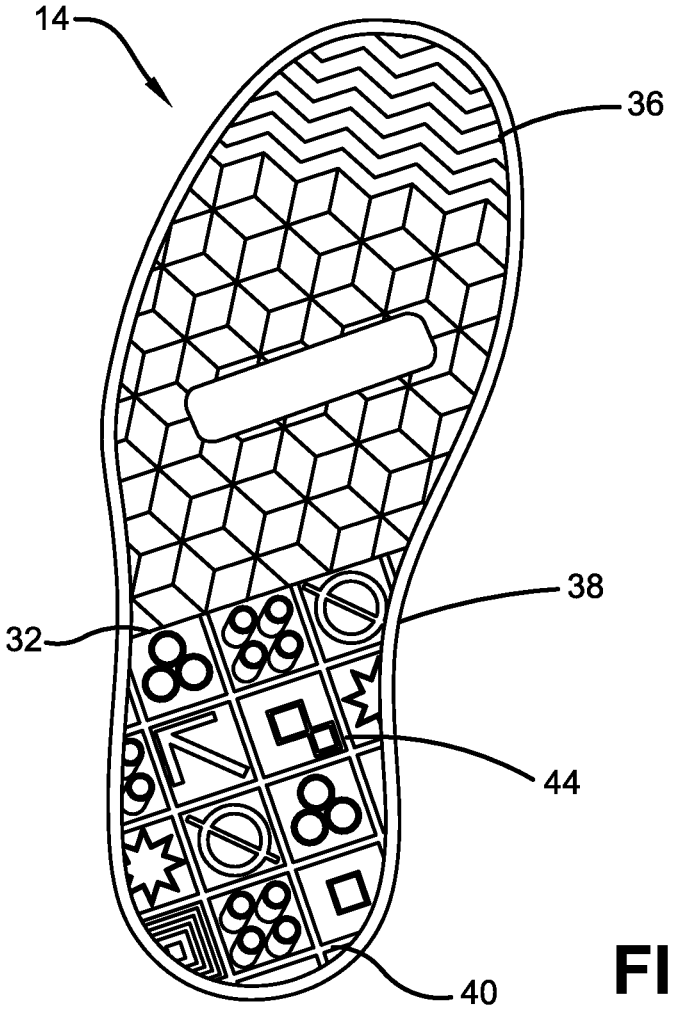
FIG. 3 is a bottom view of the sole cover of FIG. 1 when the front covering section, the middle covering section, and rear covering section all lie flat on a horizontal plane.
Figure 4:
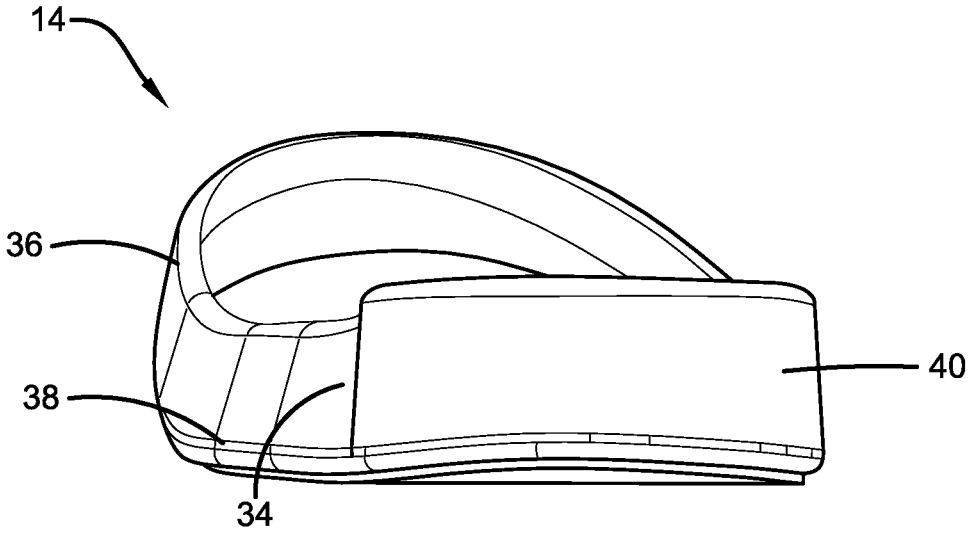
FIG. 4 is a rear and right-side perspective view of the sole cover of FIG. 1.

The sole cover 14 includes a front covering section 36, a middle covering section 38, and a rear covering section 40. The front covering section 36 covers the sole of the shoe 12 at the toe box portion 20. The middle covering section 38 covers the sole 16 of the shoe 12 at the waist portion 22. The rear covering section 40 covers the sole 16 of the shoe 12 at the heel portion 24 of the shoe 12. In this embodiment, the front covering section 36 has a length approximately equal to a third of the length of the sole cover 14. The sole cover 14 is shaped to match the shape of the sole 16 of the shoe 12 except for the toe box portion 20, which will be explained further. As illustrated in FIG. 2, in the undeformed state of the sole cover 14, the front covering section 36 angles upwardly and forwardly relative to the middle covering section 38 at an angle A between 5 and 80 degrees when the middle covering section 38 lies flat on a horizontal plane. Alternatively, the angle A may be at other values. The angle A is also more than the angle between the toe box portion 20 and the waist portion 22 of the shoe 12. For example, FIG. 2 shows that the angle A is 22.8 degrees and FIG. 5 shows that the angle between the toe box portion 20 and the waist portion 22 of the shoe 12 is near zero. In essence, the front covering section 36 angles upwardly relative to the toe box portion 20 of the shoe 12 when the waist portion 22 and the middle covering section 38 lie flat on a horizontal plane in their undeformed state with their bottoms facing the horizontal plane.

To install the sole cover 14 on the shoe 12, the sole cover 14 is placed beneath the shoe and stretched while the sole cover 14 slips over the sole 16 of the shoe 12 until the bottom surface 30 of the sole 16 of the shoe 12 engages top surface 46 (FIG. 1) of the bottom wall 32 of the sole cover 14. The top surface 46 and also the rest of the inner surface of the sole cover 14 may be a rough or friction causing surface such as treads or grooves molded therein to further improve the attachment of the sole 16 of the shoe 12 to the sole cover 14. Once the bottom surface 30 engages the top surface 46, the side wall 34 of the sole cover 14 is pulled at or slightly above the height of sole 16. Then, the pulling force is removed and the sole cover 14 is released. When completely installed and released, the side wall 34 covers the entire side 48 of the sole 16 of the shoe 12, but does not cover any portion of the upper 18 of the shoe 12 as shown in FIG. 6. That is, the side wall 34 extends to a top rim 50 (FIG. 5) of the sole 16 but does not extend past the top rim 50 of the sole 16. Also, the bottom wall 32 of the sole cover 14 covers the bottom surface 30 of the shoe 12 to protect the sole 16 from abrasion, wear, and tear while simultaneously enhancing the aesthetics of the shoe 12. Since the angle A is more than the angle between the toe box portion 20 and the waist portion 22 of the shoe 12 and the sole cover 14 is substantially more elastic than the sole 16, the front covering section 36 bends downwardly when the shoe 12 is installed in the sole cover 14. Due to the elasticity of the sole cover 14, the bended front covering section 36 is urged upwardly, by the elastic force at the bend region, against the bottom surface 30 of the shoe 12, which is substantially less elastic.

The angle A and elasticity of the sole cover 14 are of sufficient values to enable the sole cover 14 to urge the bottom wall 32 of the sole cover 14 (at the front covering section 36) upwardly against the bottom surface 30 of shoe 12 to tightly fit and secure the sole cover 14 on the shoe 12 without the use of adhesive to secure the sole cover 14 to the shoe 12. The angle and elasticity of the sole cover 14 are also of sufficient values to urge the bottom wall 32 of the sole cover 14 (at the front covering section 36) upwardly against the bottom surface 30 of the shoe 12 to tightly fit and secure the sole cover 14 on the shoe 12 without the need for the sole cover 14 to extend over the top of the upper 18 at the toe box portion 20 to secure the sole cover 14 to the shoe 12. Thus, the sole cover 14 does not obscure the top of the upper 18 of the shoe 12, thereby maintaining the aesthetic appearance of the upper 18 of the shoe 12. In essence, upon being assembled to the shoe 12, the sole cover 14 functions by using a combination of a preloaded force via the curvature/angle, friction, and elasticity to remain attach to the sole 16 of the shoe 12. The sole cover 14 may be removed from the shoe 12 by a user grasping the side wall 34 and stretching the side wall 34 outwardly away from the shoe 12 to enable the shoe 12 to slip out of the sole cover 14 when pulled out by a user.

Figure 7:
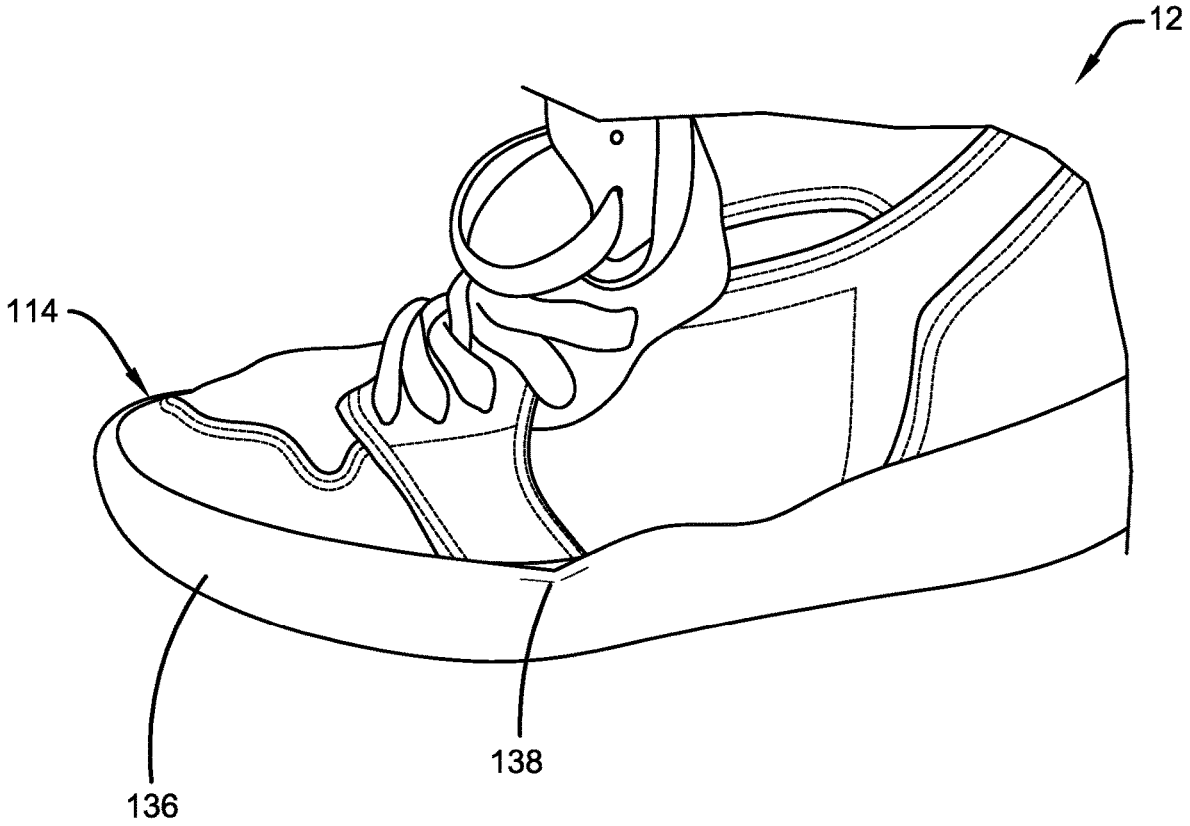
FIG. 7 is a right side perspective view of a portion of the sole cover attached to the shoe of FIG. 5 in which the front covering section of the sole cover does not angle upwardly and forwardly relative to the middle covering section of the sole cover according to a second embodiment of the present invention.

FIG. 7 shows a second embodiment of the sole cover 114 of the present invention on the shoe 12. In this second embodiment, the sole cover removably attaches to the shoe sole 16. In the undeformed state of the sole cover 114, the front covering section 136 does not angle upwardly and forwardly relative to the middle covering section 138. So, this version does not account for the inherent deformation of the sole cover that occurs during the act of walking. Specifically, as illustrated in FIG. 7, bowing of the sole cover occurs in which the sides of the sole cover 114 spread outwardly when the heel portion 24 of the shoe 12 is lifted up. By having the front covering section 136 angle upwardly relative to the toe box portion 20 of the shoe 12 as illustrated in the first embodiment of FIGS. 1-6, the bowing was surprisingly substantially reduced or eliminated. In all other aspects, the second embodiment is similar to that of the first embodiment of the present invention.

Figure 8:
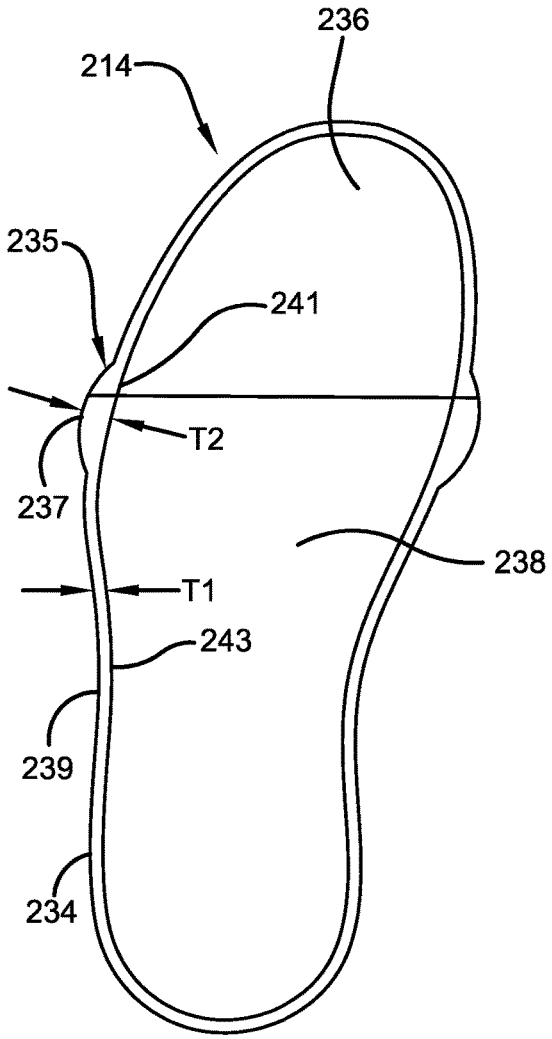
FIG. 8 is a top view of the sole cover according to a third embodiment of the present invention.

FIG. 8 shows a third embodiment of the present invention. In this embodiment, the sole cover 214 has a side wall 234 with a thickened area 235 at or near the junction of front and middle covering sections 236, 238 where the bending occurs. The thickened area 235 has a thickness T2 or width that is greater than the thickness T1 of the remaining section of the side wall 234. In particular, the thickened area 235 has an outer projection 237 that extends radially outwardly beyond an outer side 239 of the remaining section of the side wall 234. An inner side 241 of the thickened area 235 is flushed with an inner side 243 of the remaining section of the side wall 234. The thickened area 235 prevents or mitigates the bowing of the sole cover 214. FIG. 8 shows one example of the thickened area 235, but it should be known that the thickened area 235 can take many forms or shapes. The increase in thickness may happen gradually or rapidly. The thickened area 235 may also be a thick line, circle, triangle, polygon or other suitable shape. The thickened area 235 will not necessarily involve an entire portion of the sidewall being made thicker, although it may. The thickness T2 of the thickened area 235 may be 5 percent or more than the thickness T1 of the remaining section of the side wall 234. In all other aspects, the third embodiment is similar to that of the first embodiment of the present invention.

Figure 9:
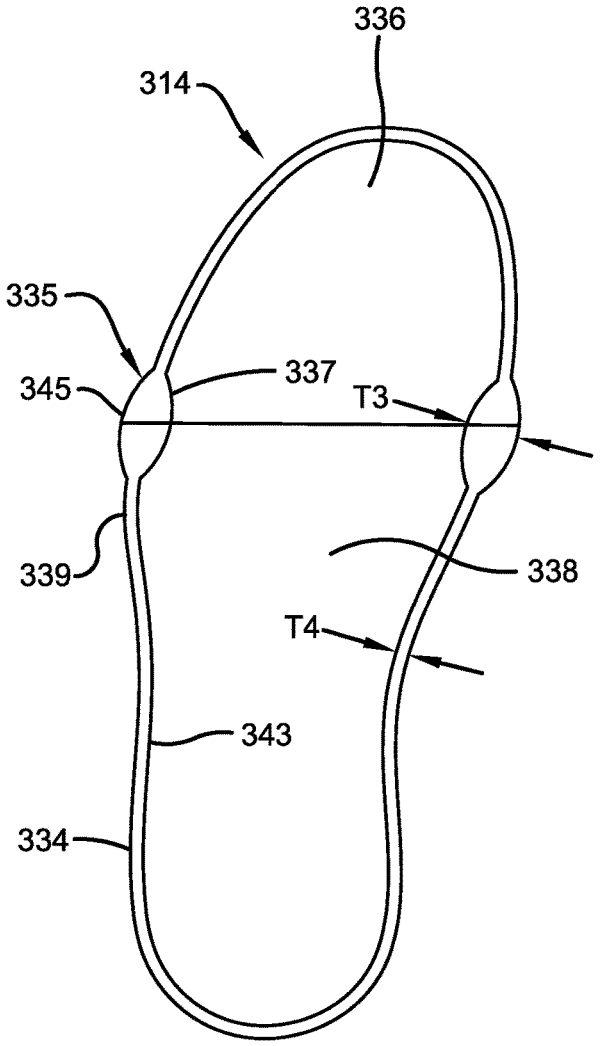
FIG. 9 is a top view of the sole cover according to a fourth embodiment of the present invention.

FIG. 9 shows the fourth embodiment of the present invention. In this embodiment, the sole cover 314 has a side wall 334 with a thickened area 335 at or near the junction of front and middle covering sections 336, 338 where the bending occurs. The thickened area 335 has a thickness T3 or width that is greater than the thickness T4 of the remaining section of the side wall 334. In particular, the thickened area 335 has an inner projection 337 that extends radially inwardly beyond an inner side 343 of the remaining section of the side wall 334. An outer side 345 of the thickened area 335 is flushed with an outer side 339 of the remaining section of the side wall 334. The thickened area 335 prevents or mitigates the bowing of the sole cover 314. FIG. 9 shows one example of the thickened area 335, but it should be known that the thickened area 335 can take many forms or shapes. The increase in thickness may happen gradually or rapidly. The thickened area 335 may also be a thick line, circle, triangle, polygon or other suitable shape. The thickened area 335 will not necessarily involve an entire portion of the sidewall being made thicker, although it may. The thickness T3 of the thickened area 335 may be 5 percent or more than the thickness T4 of the remaining section of the side wall 234. In all other aspects, the fourth embodiment is similar to that of the first embodiment of the present invention.

Figure 10:
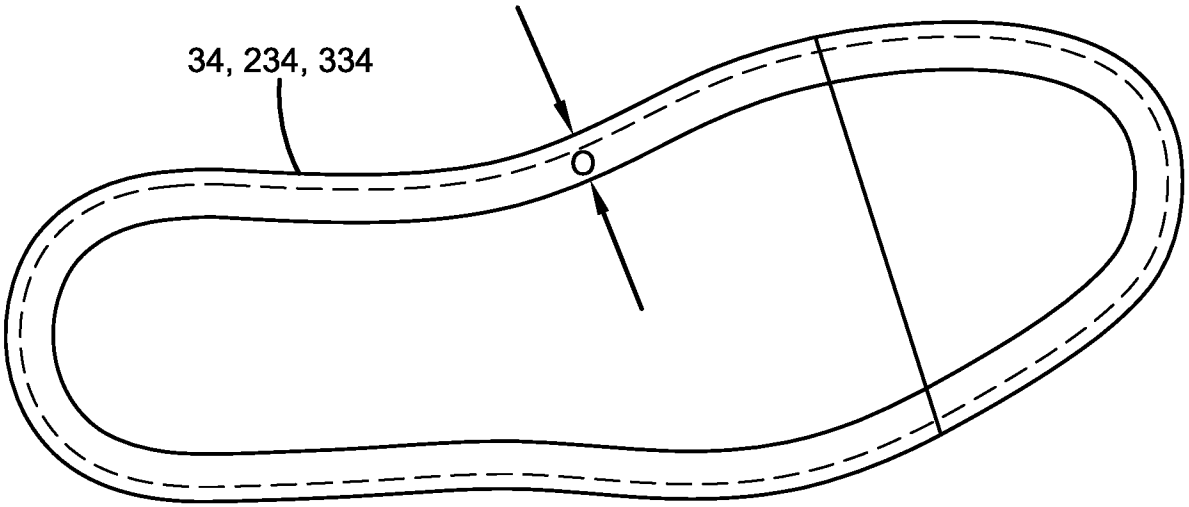
FIG. 10 is a top view of the sole cover that shows an offset of the side wall that may be included in one or more of the embodiments of the present invention.

In the one or more embodiments, the side wall 34, 234, or 334 may bend or slope radially inwardly as it extends upwardly as shown in FIG. 10. In essence, the top perimeter of the side wall 34, 234, or 334 is smaller than the bottom perimeter of the side wall 34, 234, or 334 resulting in an offset O. This offset O is defined as the horizontal distance (when the sole cover lies flat on a horizontal plane) between the inner top edge of the side wall and the outer bottom edge of the side wall. The offset may be constant or arbitrary around the perimeter of the sidewall. In other words, there may be no offset at the heel of the shoe, but sufficient (constant or non-constant) offset at or near the toe box. This will act as an additional source of pre-tension to help to prevent bowing and additionally will help the device fit on the shoe better.

FIGS. 11 to 14 show a fifth embodiment of the present invention. This fifth embodiment comprises an apparatus 400 (FIG. 13) that comprises the shoe 12 which may be worn by a user and a sole cover 414 removably attached to the shoe 12. The sole cover 414 is made of an elastic material such as thermoplastic polyurethane (TPU). The sole cover 414 may include a silicon-based material and/or additives to increase its elasticity. The TPU may have a modulus of elasticity in the range between 0.25 GPa and 10 GPa. The sole cover 414 may also include additives that attenuate discoloration due to the elements. Additives may be a combination of Antioxidants, Hindered Light Amine Stabilizers (HALS), Ultraviolet (UV) Absorbers, and/or Quenchers. Another additive may be a phosphorescent and/or a pigment for aesthetic purposes.

Figure 11:
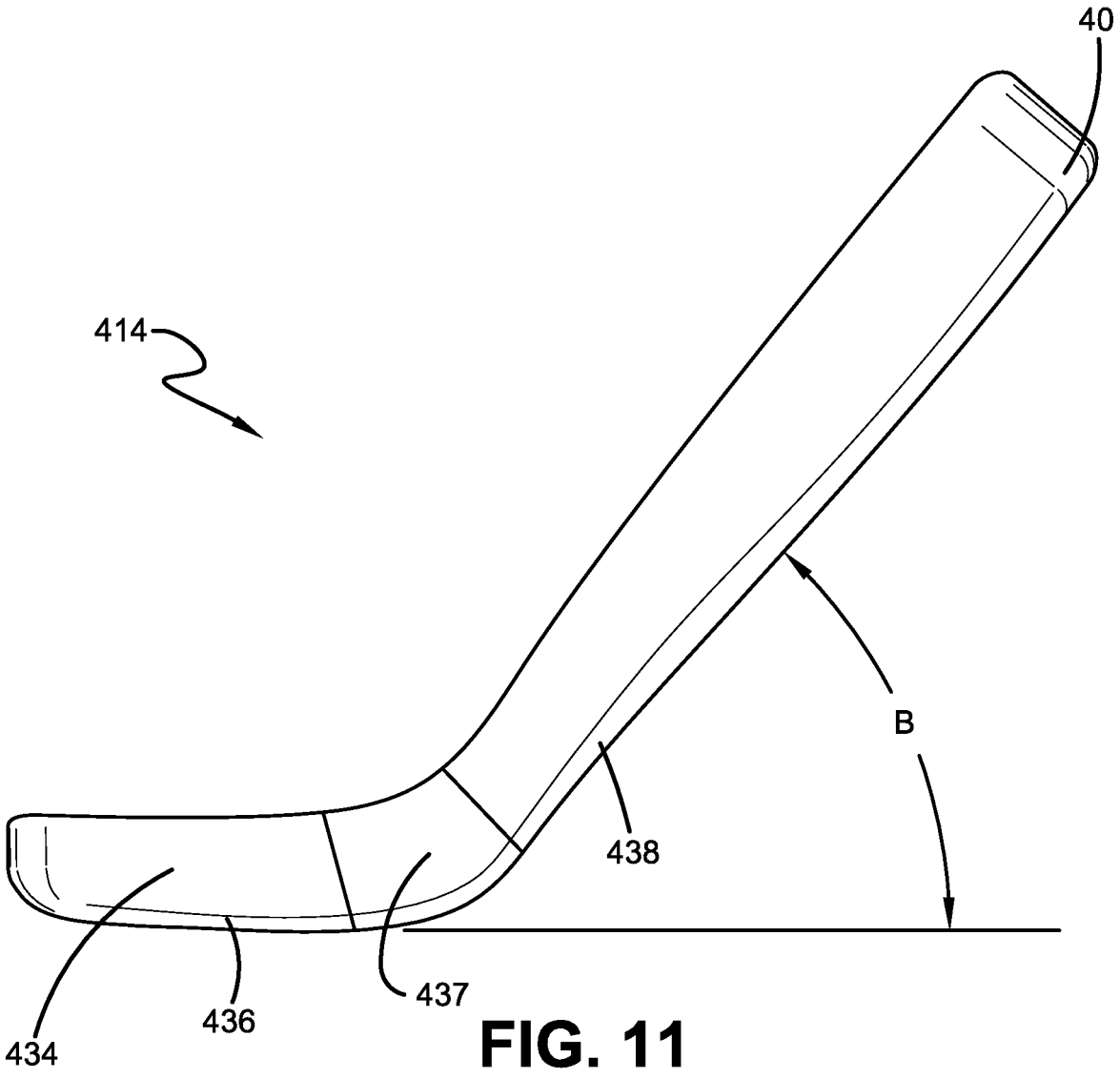
FIG. 11 is a side view of the sole cover according to a fifth embodiment of the present invention.

The sole cover 414 includes a front covering section 436, a middle covering section 438, and a rear covering section 440. The front covering section 436 covers the sole of the shoe 12 at the toe box portion 20. The middle covering section 438 covers the sole 16 of the shoe 12 at the waist portion 22. The rear covering section 440 covers the sole 16 of the shoe 12 at the heel portion 24 of the shoe 12. In this embodiment, the front covering section 436 has a length approximately equal to a third of the length of the sole cover 414. The sole cover 414 is shaped to match the shape of the sole 16 of the shoe 12 except for the toe box portion 20, which will be explained further. As illustrated in FIG. 11, the sole cover 414 is pre-deformed such that middle and rear covering sections 438, 440 angle upwardly from a front covering section 436 going in the rearward direction to form an angle B relative to the front covering section 436 when the front covering section 436 lies flat on a horizontal plane as illustrated in FIG. 11. In other words, the sole cover 414 may be pre-deformed such that the front cover section 436 angles upwardly from the middle and rear covering sections 438, 440 going in the forward direction to form the angle B relative to the middle and rear covering sections 438, 440 when the middle and rear cover sections 438, 440 lie flat on a horizontal plane. This design of the pre-deformed sole cover 414 mitigates the creases that occur on the sole cover 414 due to buckling of the critical sections during walking. The pre-deformed sole cover 414 is designed to fit perfectly (no clearance between the sole of the shoe and sole cover) onto the sole which is deformed during the walking cycle. The angle B of deformation is determined by the maximum angle the shoe would deform in a normal walking regime. This angle B is obtained by scanning the deformed sole and it can vary for different shoe designs, but it may be somewhere in the range of 5 to 80 degrees. In one example, the angle B is 45 degrees.

Figure 12:
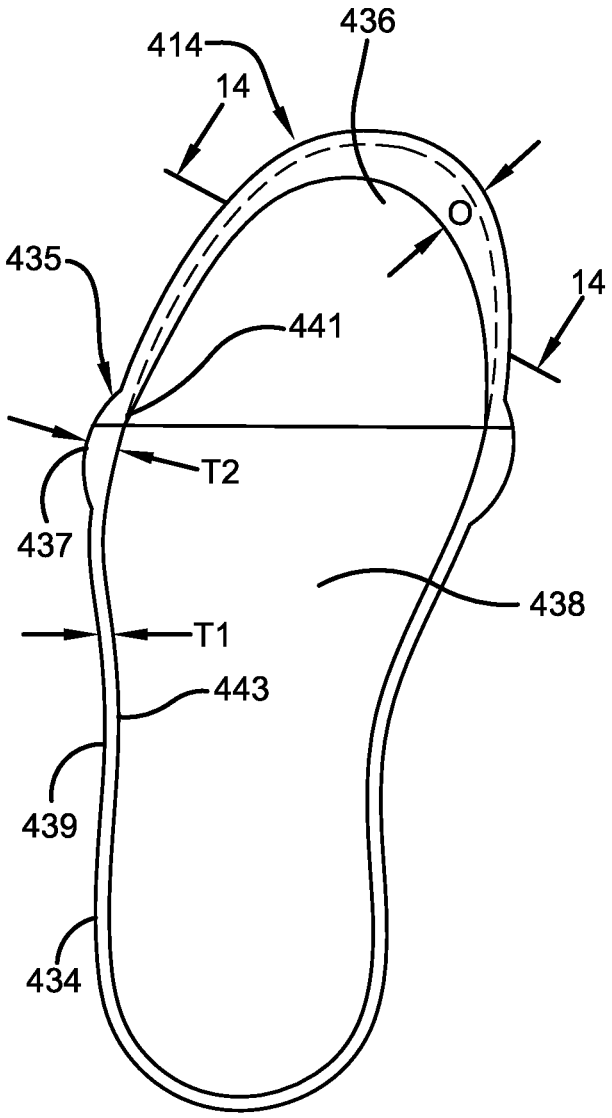
FIG. 12 is a top view of the sole cover of FIG. 11.

The section of the sole cover 414 that buckles is reinforce with thicker material as shown in FIG. 12 to negate the effects of thinning of the material from the stretching of the sole cover to fit the deformed sole with zero clearance. In this exemplary embodiment, the sole cover 414 has a side wall 434 with a thickened area 435 at or near the junction of front and middle covering sections 436, 438 where the bending occurs. The thickened area 435 has a thickness T2 or width that is greater than the thickness T1 of the remaining section of the side wall 434. In particular, the thickened area 435 has an outer projection 437 that extends radially outwardly beyond an outer side 439 of the remaining section of the side wall 434. An inner side 441 of the thickened area 435 is flushed with an inner side 443 of the remaining section of the side wall 434. The thickened area 435 prevents or mitigates the bowing of the sole cover 414. FIGS. 11 and 12 show one example of the thickened area 435, but it should be known that the thickened area 435 can take many forms or shapes. The increase in thickness may happen gradually or rapidly. The thickened area 435 may also be a thick line, circle, triangle, polygon, or other suitable shapes. The thickened area 435 will not necessarily involve an entire portion of the sidewall being made thicker, although it may. The thickness T2 of the thickened area 435 may be 5 percent or more than the thickness T1 of the remaining section of the side wall 434.

Figure 14:
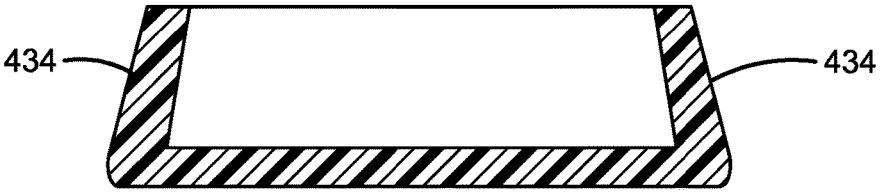
FIG. 14 is a sectional view taken along line 14-14 of FIG. 12.

In one example, the increase in thickness may be approximately 0.1 to 90 mm to negate the effects of this thinning when the sole cover 414 stretches when the front covering section 436, middle covering section 438, and rear covering section 440 are all laid flat on a relatively flat ground. The side wall 434 of the sole cover also has an offset O at the front covering section 36 for maximal fit and deformation reduction as seen in FIGS. 12 and 14. This offset O is defined as the horizontal distance (when the sole cover 414 lies flat on a horizontal plane) between the inner top edge of the side wall 434 and the outer bottom edge of the side wall 434. The offset O may be 1 to 40 percent of the width of the shoe cover. There may or may not be an offset of the side wall at the middle and rear covering sections 438, 440 of the sole cover 414.

Figure 13:
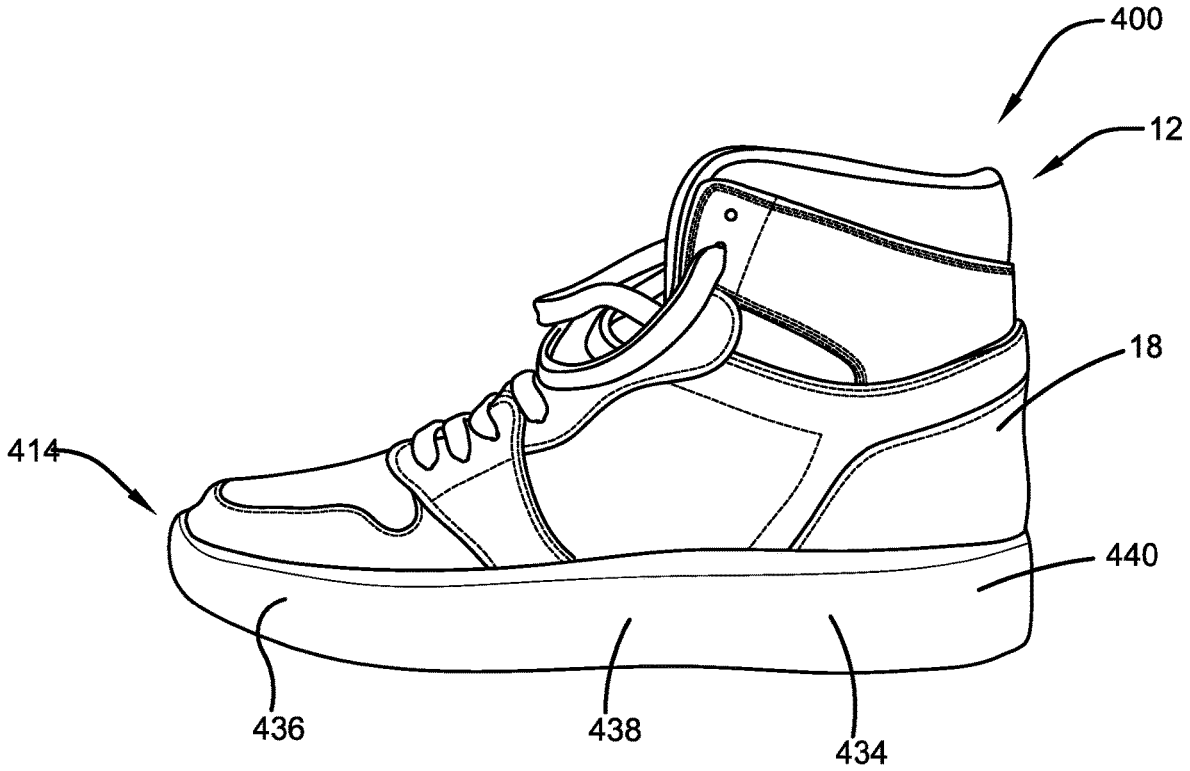
FIG. 13 is a right-side perspective view of the sole cover of FIG. 11 attached to the shoe of FIG. 5 according to the fifth embodiment of the present invention.

When the sole cover 414 is installed on the shoe 12, the side wall 434 covers the entire side 48 of the sole 16 of the shoe 12, but does not cover any portion of the upper 18 of the shoe 12 as shown in FIG. 13. That is, the side wall 434 extends to a top rim 50 (FIG. 5) of the sole 16 but does not extend past the top rim 50 of the sole 16. The sole cover 414 also includes the bottom wall 32 having the top surface 46 similar to that of the first embodiment. The top surface 46 and also the rest of the inner surface of the sole cover 414 may be a rough or friction causing surface such as treads or grooves molded therein to further improve the attachment of the sole 16 of the shoe 12 to the sole cover 414. Also, the bottom wall 32 of the sole cover 14 covers the bottom surface 30 of the shoe 12 to protect the sole 16 from abrasion, wear, and tear while simultaneously enhancing the aesthetics of the shoe 12.

Since the angle B is more than the angle between the toe box portion 20 and the waist portion 22 of the shoe 12 and the sole cover 414 is substantially more elastic than the sole 16, the front covering section 436 bends downwardly when the shoe 12 is installed in the sole cover 414. Due to the elasticity of the sole cover 414, the bended front covering section 436 is urged upwardly, by the elastic force at the bend region, against the bottom surface 30 of the shoe 12, which is substantially less elastic. The angle B and elasticity of the sole cover 14 are of sufficient values to enable the sole cover 414 to urge the bottom wall 32 of the sole cover 414 (at the front covering section 436) upwardly against the bottom surface 30 of shoe 12 to tightly fit and secure the sole cover 414 on the shoe 12 without the use of adhesive to secure the sole cover 414 to the shoe 12. The angle and elasticity of the sole cover 414 are also of sufficient values to urge the bottom wall 32 of the sole cover 414 (at the front covering section 436) upwardly against the bottom surface 30 of the shoe 12 to tightly fit and secure the sole cover 414 on the shoe 12 without the need for the sole cover 414 to extend over the top of the upper 18 at the toe box portion 20 to secure the sole cover 414 to the shoe 12. In all other aspects, the fifth embodiment is similar to that of the first embodiment of the present invention. It should be noted that the bottom tread surface 44 may be on the sole covers of all of the embodiments.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above-described embodiment, method, and examples, but by all embodiments and methods within the scope and spirit of the invention.

What is claimed is:

1. An apparatus comprising:

a sole cover, wherein the sole cover is configured to be removably attached to a sole of a shoe to cover the sole of the shoe, wherein the sole cover includes a first covering section and a second covering section, wherein the first covering section is configured to cover the sole of the shoe at a toe box portion of the shoe, wherein the second covering section is configured to cover the sole of the shoe at a waist portion of the shoe and at a heel portion of the shoe, wherein the first and second covering portions are flat and meet at an angle, wherein the second covering portion is at least one eighth of the length of the sole cover and the first covering portion is at least one eighth of the length of the sole cover, wherein the first covering section angles upwardly and away from the second covering section at the angle relative to the second covering section when the second covering section lies flat on a horizontal plane in an undeformed state, wherein the sole cover is of a sufficient elasticity that enables the first covering section to bend downwardly when the sole cover is attached to the sole of the shoe, wherein the angle is in the range of 26 to 80 degrees, wherein the angle and elasticity are of sufficient values to urge the sole cover against a bottom of the sole of the shoe to help secure the sole cover to the sole of the shoe when the sole cover is attached to the sole of the shoe.

2. The apparatus of claim 1, wherein the sole cover is made of thermoplastic polyurethane.

3. The apparatus of claim 1, wherein the angle is 45 degrees.

4. The apparatus of claim 1, wherein the angle is in the range of 45 to 80 degrees.

5. The apparatus of claim 1, wherein the sole cover includes one or more additives to attenuate discoloration, wherein the one or more additives is an Antioxidant.

6. The apparatus of claim 1, wherein the sole cover includes one or more additives to attenuate discoloration, wherein the one or more additives is a Quencher.

7. The apparatus of claim 1, wherein the sole cover includes one or more additives to attenuate discoloration, wherein the one or more additives is a Hindered Light Amine Stabilizers (HALS).

8. The apparatus of claim 1, wherein the sole cover includes a pigment additive.

9. The apparatus of claim 1, wherein the sole cover includes an inner surface, wherein the inner surface comprises a top surface, wherein the top surface is rough for helping to attach the sole cover to the shoe.

10. The apparatus of claim 1, wherein the sole cover includes a bottom wall and a side wall, wherein at least a portion of the side wall slopes upwardly and inwardly relative to the bottom wall of the sole cover.

11. An apparatus comprising:

a sole cover, wherein the sole cover is configured to be removably attached to a sole of a shoe to cover the sole of the shoe, wherein the sole cover includes a first covering section and a second covering section, wherein the first covering section is configured to cover the sole of the shoe at a toe box portion of the shoe, wherein the second covering section is configured to cover the sole of the shoe at a waist portion of the shoe, wherein the first covering section angles upwardly and away from the second covering section at an angle relative to the second covering section when the second covering section lies flat on a horizontal plane in an undeformed state, wherein the sole cover is of a sufficient elasticity that enables the first covering section to bend downwardly when the sole cover is attached to the sole of the shoe, wherein the angle and elasticity are of sufficient values to urge the sole cover against a bottom of the sole of the shoe to help secure the sole cover to the sole of the shoe when the sole cover is attached to the sole of the shoe, wherein the side wall includes a thickened area near or at the junction of the first and second covering sections, wherein the thickened area has a thickness that is greater than the thickness of the remaining section of the side wall, wherein the thickened area does not extend to a first distal end of the first covering section and a second distal end of the second covering section.

12. The apparatus of claim 11, wherein the thickened area extends further inward than the remaining section of the side wall.

13. The apparatus of claim 11, wherein the thickened area extends further outward than the remaining section of the side wall.

14. An apparatus comprising:

a shoe, wherein the shoe comprises a sole, an upper, a toe box portion, a waist portion, and a heel portion, wherein the upper is located above the sole; and a sole cover, wherein the sole cover is removably attached to the sole of the shoe to cover the sole of the shoe, wherein the sole cover includes a first covering section and a second covering section, wherein the first covering section covers the sole of the shoe at the toe box portion of the shoe, wherein the second covering section is configured to cover the sole of the shoe at the waist portion of the shoe, wherein the first covering section angles upwardly and away from the second covering section at an angle relative to the second covering section when the second covering section lies flat on a horizontal plane in an undeformed state, wherein the sole cover is of a sufficient elasticity that enables the first covering section to bend downwardly when the sole cover is attached to the sole of the shoe, wherein the angle and elasticity are of sufficient values to urge the sole cover against a bottom of the sole of the shoe to help secure the sole cover to the sole of the shoe when the sole cover is attached to the sole of the shoe, wherein the sole cover includes a bottom wall and a side wall, wherein at least a first portion of the side wall slopes upwardly and inwardly relative to the bottom wall of the sole cover, wherein the side wall at least partially covers a side of the sole when the sole cover is attached to the sole of the shoe, wherein the sole cover does not extend beyond a top rim of the sole of the shoe and does not cover any portion of the upper.

15. The apparatus of claim 14, wherein the first portion of the side wall slopes inwardly the entire way upwardly.

16. The apparatus of claim 14, wherein the angle is in the range of 26 to 80 degrees.

17. The apparatus of claim 14, wherein the angle is in the range of 45 to 80 degrees.

18. The apparatus of claim 14, wherein the sole cover includes one or more additives to attenuate discoloration.

19. The apparatus of claim 18, wherein the one or more additives may be one of or any combination of Antioxidants, and Quenchers.

20. The apparatus of claim 14, wherein the sole cover includes a bottom wall and a side wall, wherein the side wall extends to a top rim of a side of the sole and covers the side of the sole when the sole cover is attached to the sole of the shoe.

* * * * *